US008967622B2

(12) United States Patent
Hazard

(10) Patent No.: US 8,967,622 B2
(45) Date of Patent: Mar. 3, 2015

(54) APPARATUS AND METHOD FOR PLAYING A BINGO-TYPE GAME

(75) Inventor: Lisa Lelli Hazard, Cardiff-by-the-Sea, CA (US)

(73) Assignee: Lisa Hazard, San Diego, CA (US)

( * ) Notice: Subject to any disclaimer, the term of this patent is extended or adjusted under 35 U.S.C. 154(b) by 1705 days.

(21) Appl. No.: 11/897,795

(22) Filed: Sep. 1, 2007

(65) Prior Publication Data

US 2009/0058004 A1 Mar. 5, 2009

(51) Int. Cl.
*A63F 3/06* (2006.01)

(52) U.S. Cl.
CPC ..... *A63F 3/062* (2013.01)
USPC ..... 273/269

(58) Field of Classification Search
USPC ..... 273/269; 463/19
See application file for complete search history.

(56) References Cited

U.S. PATENT DOCUMENTS

| | | | | | |
|---|---|---|---|---|---|
| 3,197,891 | A | * | 8/1965 | Pierce | 273/269 |
| 3,495,700 | A | * | 2/1970 | Chandos | 273/269 |
| 4,021,937 | A | * | 5/1977 | Kravitz | 434/167 |
| 4,222,571 | A | * | 9/1980 | Molat | 273/237 |
| 4,883,636 | A | * | 11/1989 | Fantle, Jr. | 273/269 |
| D341,854 | S | * | 11/1993 | Mobley | D21/377 |
| 5,449,179 | A | * | 9/1995 | Hefferan | 273/269 |
| 5,458,338 | A | * | 10/1995 | Beardsley | 273/269 |
| 5,727,786 | A | * | 3/1998 | Weingardt | 273/269 |
| 5,743,740 | A | * | 4/1998 | Visser et al. | 434/128 |
| 5,957,457 | A | * | 9/1999 | Shaw | 273/269 |
| 6,409,173 | B1 | * | 6/2002 | Tri | 273/292 |
| 6,732,459 | B1 | * | 5/2004 | Clark | 40/124.06 |
| 7,040,622 | B2 | | 5/2006 | Sebesta et al. | |
| 2005/0098950 | A1 | * | 5/2005 | Yamaguchi et al. | 273/269 |
| 2006/0267280 | A1 | * | 11/2006 | Gordon | 273/269 |
| 2007/0222149 | A1 | * | 9/2007 | Bentley | 273/269 |

FOREIGN PATENT DOCUMENTS

KR 2004084519 * 10/2004

OTHER PUBLICATIONS http://web.archive.org/web/20050110040432/http://www.crateandbarrel.com/ date Jan. 10, 2005.*

* cited by examiner

*Primary Examiner* — Gene Kim
*Assistant Examiner* — Amir Klayman
(74) *Attorney, Agent, or Firm* — Tiffany M. Baughman

(57) ABSTRACT

Disclosed are a game apparatus and a method of playing a game. According to the method, a plurality of gifts is purchased from a gift list. The gifts are associated with a gift identifier. A participant is provided with a card imprinted with a plurality of gift identifiers in defined spaces, with each defined space aligned on a card. A guest of honor is instructed to open the gifts. The method includes the participants viewing the opened gifts and marking off the corresponding gift identifier on the provided card until the participant has marked off a specified number of gift identifiers. The participant that completes the task first is declared the winner.

7 Claims, 10 Drawing Sheets

Figure 3.

701

| | | | |
|---|---|---|---|
| 2pk Newborn Pacifier | 5pk Yellow Duck Receiving Blankets | White Diaper Disposal System | Ping Flowered Boppy Cover |
| 3pk 5oz. Newborn Bottles | Pink Frog Footed Sleeper | Pine 4-in-1 Convertible Crib | Ocean Print Cradle Swing |
| Single Electric Breast Pump | Digital Pacifier Thermometer | Digital Multi-room Baby Monitor | Brand Name 'A' Receiving Blanket |
| Gray & Pink Jogging Stroller | Ocean Print Newborn to Toddler Tub | Cherry Portable Pack 'n Play | Surfboard Tummy Play Mat |

Figure 4.

801

| | | | |
|---|---|---|---|
| Image of... 10" Stainless Steel Skillet | Image of... 11 Bottle Wine Fridge | Image of... Cast Aluminum 12 Rose Bunt Pan | Image of... Blue Full Size Bath Towels |
| Image of... Stainless Steel 20Qt. Stockpot | Image of... Royal Blue 24"x24" Bath Mat | Image of... White 4 Slice Toaster Oven | Image of... Blue & White Striped Luggage |
| Image of... 4pc Store and Bake Glass Bowls | Image of... Sliver Lined 20" Serving Tray | Image of... Blue & Yellow Sun Shade Beach Chairs | Image of... Set of 8 High Ball Glasses |
| Image of... Puerto Rican Everyday Cookbook | Image of... Classic Series Flatware | Image of... Black Plastic Colander | Image of... Blue Electric Juicer |

Figure 5.

901

| Guest of Honor's Bridal Shower Bingo! | | | |
|---|---|---|---|
| End Grain Chopping Block | 1000 Thread Count Ivory Sheet Set | 18" Flowered Serving Tray | Royal Blue Bath Mat |
| 70" Champagne Shower Curtain | Set of 3 Cork Trivets | White Nylon Small Slotted Turner | Nonstick Silicone Baking Pan |
| White Nylon Potato Masher | 20 Quart Stainless Steel Stockpot | Stripped Full Size Bath Towels | Set of 4 Double Old Fashion Glassware |
| Black 4 Slice Toaster Oven | Black 12 Cup Auto Drip Coffee Maker | Cast Aluminum 12 Rose Bunt Pan | 1.5 Quart Stainless Steel Colander |

Figure 6.

1001

| | | | | |
|---|---|---|---|---|
| 18" Paisley Serving Tray | Red & White Striped Bath Mat | 1000 Thread Count Ivory Sheet Set | 20" Stainless Steel Roasting Pan | 70" White Shower Curtain |
| Set of 3 Ceramic Trivets | 11 Bottle Wine Fridge | 26" Red Serving Platter | Black Nylon Large Slotted Turner | Red & White Plaid Luggage |
| 18pc Store & Bake Cookware | Ivory Down King Comforter | Theme Item "FREE SQUARE" | Yellow & Red Beach Chairs | 1000 Thread Count Ivory Pillows |
| Silver Combination Broom Vacuum | Cast Aluminum Garlic Press | Set of 4 Mini Grilling Thermometers | Silver 12 Cup Auto Drip Coffee Maker | Silver Diamond Cut Cocktail Shaker |
| Cast Iron Indoor Griddle | Rose Embossed Flatware Set | Italian Cookbook | Multi-colored Measuring Cups | White Full Size Bath Towels |

Figure 7.

2001

| | | | | |
|---|---|---|---|---|
| 18" Paisley Serving Tray | Red & White Striped Bath Mat | 1000 Thread Count Ivory Sheet Set | 20" Stainless Steel Roasting Pan | 70" White Shower Curtain |
| Set of 3 Ceramic Trivets | 11 Bottle Wine Fridge | 26" Red Serving Platter | Black Nylon Large Slotted Turner | Red & White Plaid Luggage |
| 18pc Store & Bake Cookware | Ivory Down King Comforter | Theme Item "FREE SQUARE" | Yellow & Red Beach Chairs | 1000 Thread Count Ivory Pillows |
| Silver Combination Broom Vacuum | Cast Aluminum Garlic Press | Set of 4 Mini Grilling Thermometers | Silver 12 Cup Auto Drip Coffee Maker | Silver Diamond Cut Cocktail Shaker |
| Cast Iron Indoor Griddle | Rose Embossed Flatware Set | Italian Cookbook | Multi-colored Measuring Cups | White Full Size Bath Towels |

Figure 9.

4001

| | | | | |
|---|---|---|---|---|
| 18" Paisley Serving Tray | Red & White Striped Bath Mat | 1000 Thread Count Ivory Sheet Set | 20" Stainless Steel Roasting Pan | 70" White Shower Curtain |
| Set of 3 Ceramic Trivets | 11 Bottle Wine Fridge | 26" Red Serving Platter | Black Nylon Large Slotted Turner | Red & White Plaid Luggage |
| 18pc Store & Bake Cookware | Ivory Down King Comforter | Theme Item "FREE SQUARE" | Yellow & Red Beach Chairs | 1000 Thread Count Ivory Pillows |
| Silver Combination Broom Vacuum | Cast Aluminum Garlic Press | Set of 4 Mini Grilling Thermometers | Silver 12 Cup Auto Drip Coffee Maker | Silver Diamond Cut Cocktail Shaker |
| Cast Iron Indoor Griddle | Rose Embossed Flatware Set | Italian Cookbook | Multi-colored Measuring Cups | White Full Size Bath Towels |

APPARATUS AND METHOD FOR PLAYING A BINGO-TYPE GAME

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND

The present invention relates generally to the game of bingo, and more particularly, to an apparatus and method for playing a game.

The traditional game of bingo is played with a card having twenty-four numbers arranged in a five-by-five matrix with a free space in the center. As the game is played, various patterns may be achieved from a draw of numbers from a set of numbers conventionally totaling seventy-five in the United States and ninety in other parts of the world. The first matching of numbers forming any one of specific patterns (e.g., a line of five numbers vertically, horizontally or diagonally) would create the game ending event for which a prize is awarded.

Accordingly, a bingo-type game that can be played at an event along with the gift opening which includes the gifts that a guest of honor has requested on a registered gift list and thus those gifts that each participant has purchased is desirable. The present invention provides a fun game for this purpose.

SUMMARY

We are disclosing a game apparatus and a method of playing a game. The inventor recognized a need for the guest of honor or host of a party to establish a registered list of gift items and create a game customized to such list. In one aspect, the game features a game apparatus that comprises a registered gift list. The registered gift list includes a plurality of gift items wherein each gift item is associated with an item identifier. The game apparatus also includes a plurality of cards wherein each card includes a plurality of defined spaces arranged in a pattern. There is at least one space associated with each card containing an item identifier. The plurality of cards includes a first card containing at least a first item identifier, and a second card containing at least a second item identifier wherein the second item identifier is different from the first item identifier. In one implementation, the pattern comprises a grid. In another implementation, the spaces comprise squares. In yet another implementation, the item identifier is text. In yet another implementation, the item identifier is an image. In yet another implementation, the item identifier is text and an image. In yet another implementation, at least one of the defined spaces is a free space. In yet another implementation, at least one of the defined spaces represents a prize. In yet another implementation, at least one of the defined spaces is a blank space. In yet another implementation, at least one defined space is populated in an automated fashion using a pool of information accessed via a computer network such as the Internet.

In another aspect, the game features a game apparatus that comprises a registered gift list that includes a plurality of gift items. Each gift item is associated with an item identifier. There is a plurality of cards wherein each card includes a plurality of defined spaces arranged in a pattern. There is at least one space associated with each card containing an item identifier. The plurality of cards includes a first card with defined spaces arranged in a first order and a second card with defined spaces arranged in a second order wherein the second order differs from the first order with respect to at least one defined space. In one implementation, the pattern comprises a grid. In another implementation, the spaces comprise squares. In yet another implementation, the item identifier is text. In yet another implementation, the item identifier is an image. In yet another implementation, the item identifier is text and an image. In yet another implementation, at least one of the defined spaces is a free space. In yet another implementation, at least one of the defined spaces represents a prize. In yet another implementation, at least one of the defined spaces is a blank space. In yet another implementation, at least one defined space is populated in an automated fashion using a pool of information accessed via a computer network such as the Internet.

In another aspect, the invention features a method of playing a game. The method includes providing a plurality of gift items at least one of the gift items having been purchased from a registered gift list. There is a barrier for individually covering each of the gift items from view. Each participant is provided with a card imprinted with a plurality of gift identifiers. Each gift identifier is imprinted in a defined space. Each defined space is aligned on the card. All of the gift identifiers are associated with items listed on the guest of honor's registered gift list. The method further includes providing a participant with a marker for making marks on the card. The guest of honor is instructed to remove such barrier thereby providing a revealed gift item. Each participant is instructed to mark off the gift identifier on said card, when the gift identifier corresponds to the revealed gift item. The guest of honor continues to remove the barriers from other gift items providing additional revealed gift items until the participant has marked off gift identifiers in a specified number of spaces. The participant is instructed to vocalize a response when all of the gift identifiers in the specified number of spaces have been marked, at which time the participant is declared a winner. In one implementation, the specified number of spaces comprises a row. In another implementation, the specified number of spaces comprises a column. In yet another implementation, the specified number of spaces comprises a corner to corner diagonal row. In yet another implementation, the specified number of spaces comprises all the spaces imprinted on the card. In yet another implementation, the specified spaces comprise an identifiable pattern. In yet another implementation, the participants continue play by drawing gift identifiers from a container until such time as a participant can be declared a winner.

One advantage of the present game apparatus and method of playing a game is the game is customized to the guest of honor and the gifts that the guest of honor has requested using a registered gift list. Another advantage is the participants are able to view the gifts that they purchased for the guest of honor and mark those specific gifts off on the game card thereby enhancing their enjoyment. Another advantage is that there is increased possibility of a winner for each game because the card is populated using gifts requested from the registered gift list.

BRIEF DESCRIPTION OF THE SEVERAL VIEWS OF THE DRAWINGS

The above and further advantages of this invention may be better understood by referring to the following description in conjunction with the accompanying drawings, in which the numerals indicate like structural elements and features in various figures. The drawings are not necessarily to scale, emphasis instead being placed upon illustrating the principles of the invention.

FIG. 3 depicts the face of a card according to an implementation of the present invention.

FIG. 4 is an illustration of a game card according to an implementation of the present invention.

FIG. 5 depicts a game card according to an implementation of the present invention.

FIG. 6 is an illustration of a winning game card according to an implementation of the present invention.

FIG. 7 is an illustration of a winning game card according to an implementation of the present invention.

FIG. 9 is an illustration of a winning game card according to an implementation of the present invention.

DETAILED DESCRIPTION OF THE INVENTION

In brief overview, a game constructed in accordance with the present invention enables a guest of honor to compile a list of gifts for a particular occasion using a gift registry or wish list. A game card is populated using the gift list by assigning gift identifiers to the gifts listed thereon. Each card in a set of cards has a unique order of defined spaces, or a unique set of gift identifiers such that no card in a set is identical. The host of the party or guest of honor instructs the participants that a specified number of spaces must be marked in order for the participant to be declared a winner. The specified number of spaces could be a row (horizontal, vertical, or diagonal in direction), all of the spaces on a card, or an identifiable shape. The participants observe the guest of honor opening the gifts and mark off each gift identifier on the game card as the gift pertaining to that gift identifier is opened. When a participant has marked off the specified number of spaces, the participant vocalizes that he or she is the winner.

Figure 1:
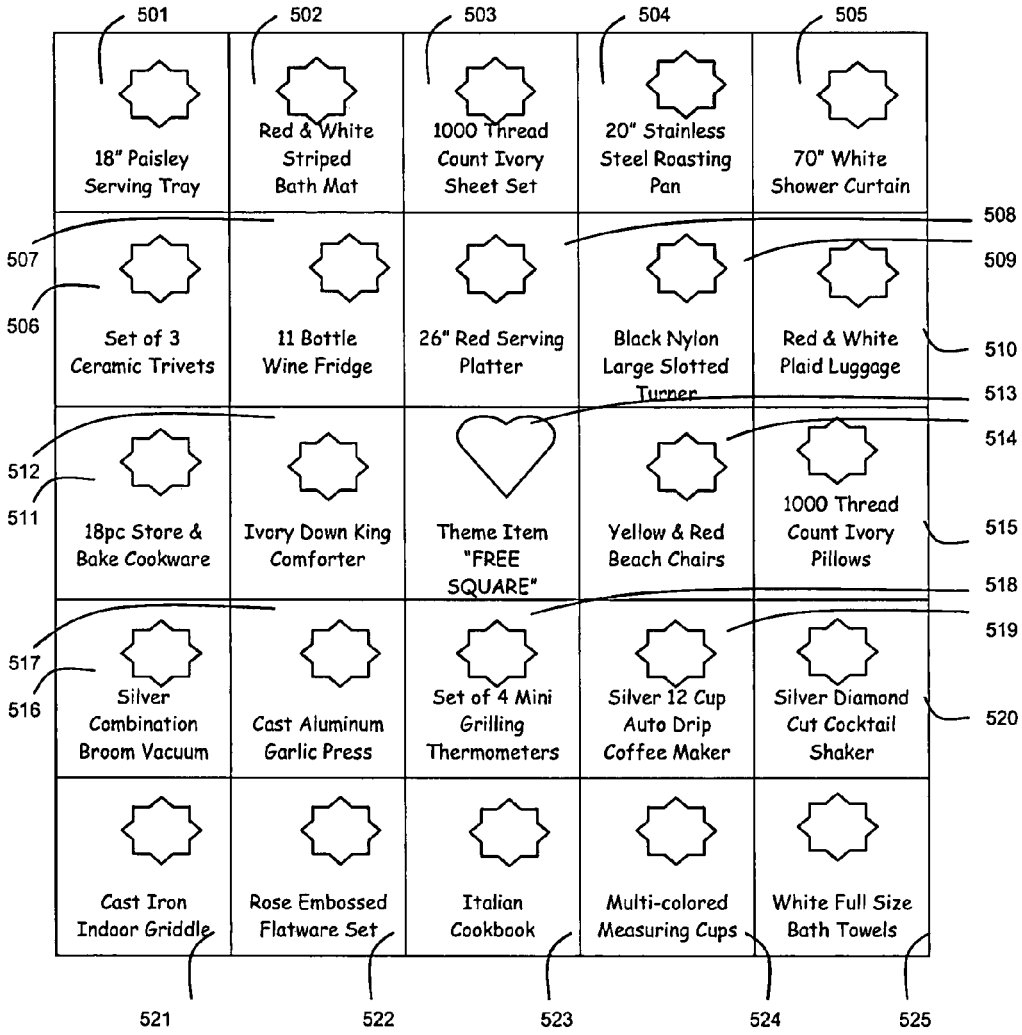
FIG. 1 is an illustration of a first card in a set of cards according to an implementation of the present invention.

A plurality of boards or cards (each card generally referenced as FIG. 1, also termed board), comprising a set of game cards provided. Each card in each set is provided with a plurality of defined spaces (each defined space generally referenced as 501). Referring to FIG. 1 which shows a first card in a first set of game cards, each defined space on the first card is a square 501-525. A square can contain an identifier that describes a gift. It can be one or more of a text description, an image, or both. Further, it is contemplated that a card can contain one or more of a free square or a blank square. For example, 513 is a free square with an image of a theme item. A card can contain a plurality of those types of squares. Any combination of those types of squares is contemplated. The first card of a designated number of cards for playing a game to enhance the enjoyment of participants at a gathering at which gifts are opened by the guest of honor while the participants watch, has a first square 501 in the upper left hand corner of the card bearing the name of the gift item "18" Paisley Serving Tray" and a graphic depiction thereof imprinted thereon. This square is a member of a first horizontal row, of a first vertical row, and of a first diagonal row. The second square 502 in the first horizontal row has the name of the gift item "Red and White Striped Bath Mat" and a graphic depiction thereof imprinted thereon. The second square 502 is a member of the first horizontal row and is a member of the second vertical row, and so on to each subsequently named square. Continuing across the first horizontal row, square 503 has "1000 Thread Count Ivory Sheet Set" and a graphic depiction thereof, square 504 has "20" Stainless Steel Roasting Pan" and a graphic depiction thereof, square 505 has "70" White Shower Curtain" and a graphic depiction thereof imprinted thereon. Continuing with the second horizontal row, square 506 has "Set of 3 Ceramic Trivets" and a graphic depiction thereof, square 507 has "11 Bottle Wine Fridge" and a graphic depiction thereof, square 508 has "26" Red Serving Platter" and a graphic depiction thereof, square 509 has "Black Nylon Large Slotted Turner" and a graphic depiction thereof, and square 510 has "Red and White Plaid Luggage" and a graphic depiction thereof imprinted thereon. In the third horizontal row, square 511 has "18 pc. Store and Bake Cookware" and a graphic depiction thereof, square 512 has "Ivory Down King Comforter" and a graphic depiction thereof, square 513 has "Free Square" and a graphic depiction of the designated theme of the occasion which is being celebrated thereof, square 514 has "Yellow and Red Beach Chairs" and a graphic depiction thereof, and square 515 has "1000 Thread Count Ivory Pillows" and a graphic depiction thereof imprinted thereon. In the fourth horizontal row, square 516 has "Silver Combination Broom Vacuum" and a graphic depiction thereof, square 517 has "Cast Aluminum Garlic Press" and a graphic depiction thereof, square 518 has "Set of 4 Mini Grilling Thermometers" and a graphic depiction thereof, square 519 has "Silver 12 Cup Auto Drip Coffee Maker" and a graphic depiction thereof, and square 520 has "Silver Diamond Cut Cocktail Shaker" and a graphic depiction thereof imprinted thereon. In the fifth horizontal row, square 521 has "Cast Iron Indoor Griddle" and a graphic depiction thereof, square 522 has "Rose embossed Flatware Set" and a graphic depiction thereof, square 523 has "Italian Cookbook" and a graphic depiction thereof, square 524 has "Multi-colored Measuring Cups" and a graphic depiction thereof, and square 525 has "White Full Size Bath Towels" and a graphic depiction thereof imprinted thereon.

Figure 2:
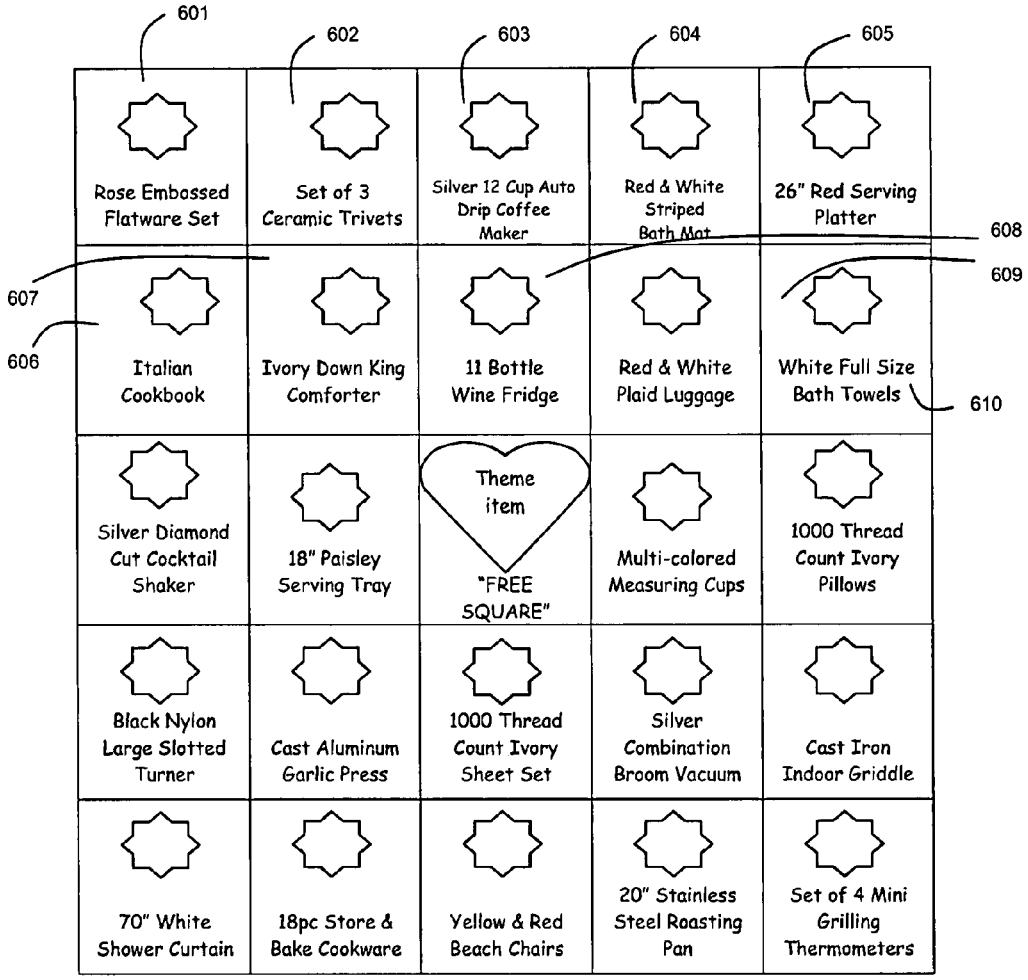
FIG. 2 is an illustration of a second card in a set of cards according to an implementation of the present invention

FIG. 2 illustrates a second card which is a member of the first set of game cards. Herein, it can be seen that the squares having the names of gifts and graphic depictions thereof imprinted thereon are arranged in a different pattern, thereby rendering the second card distinct from the first card of the set. The squares can be shifted in any manner so that they are in a random order. As shown, the first square 601 in the upper left hand corner of the card bears the name of the gift item "Rose Embossed Flatware Set" and a graphic depiction thereof imprinted thereon. Square 602 has the name "Set of 3 Ceramic Trivets" and a graphic depiction thereof imprinted thereon. Continuing across the first horizontal row, square 603 has "Silver 12 Cup Auto Drip Coffee Maker" and a graphic depiction thereof, square 604 has "Red and White Striped Bath Mat" and a graphic depiction thereof, and square 605 has "26" Red Serving Platter" and a graphic depiction thereof imprinted thereon. Continuing with the second horizontal row, square 606 has "Italian Cookbook" and a graphic depiction thereof, square 607 has "Ivory Down King Comforter" and a graphic depiction thereof, square 608 has "11 Bottle Wine Fridge" and a graphic depiction thereof, square 609 has "Red and White Plaid Luggage" and a graphic depiction thereof, and square 610 has "White Full Size Bath Towels" and a graphic depiction thereof imprinted thereon, and so on. The randomization having been achieved by utilizing any means of randomization of the names and images of gift items that gives rise to a set of cards wherein each card is distinct from each other card in the set. Further, it is contemplated that for each of the cards in a set at least one of the squares differs from a square on another card in that set, such that at least one space associated with each card contains an item identifier, where the first card in a set of cards contains at least one first item identifier, and the second card in a set of cards contains at least a second item identifier wherein the second item identifier is different from the first item identifier. For example, on one or more cards, the gift item "Red Serving Platter" may be replaced by the gift item "End Grain Chopping Block".

Referring now to FIG. 3 which illustrates the face of a game card wherein text 701 is used as an item identifier.

Referring now to FIG. 4 which illustrates the face of a game card wherein an image 801 is used as item identifiers.

Figure 8:
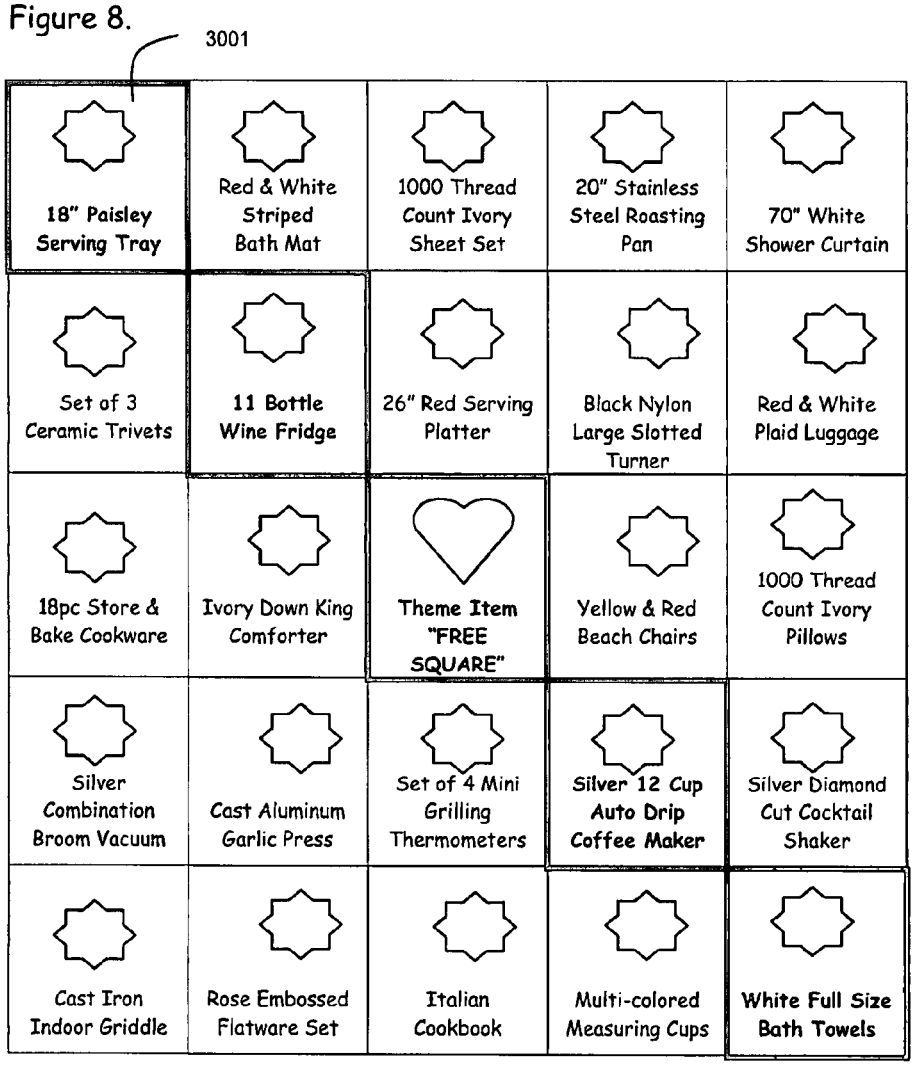
FIG. 8 is an illustration of a winning game card according to an implementation of the present invention.

Preferably, the game card is generally rectangular in shape in the set of game cards. Referring now to FIG. 5 which illustrates the face of a game card wherein a area is set forth at the top of the card for imprinting a title or other marking thereon. For example, in a title 901 denoting the "Guest of Honor's Bridal Shower Bingo!" is imprinted thereon. Each card is provided with a plurality of imprints of defined spaces and is not considered to be limited to a particular number of imprints of defined spaces. In the preferred implementation, the plurality of defined spaces is arranged in a rectangular matrix having discrete rows. These rows are horizontally, vertically, and diagonally arranged on the game card. However, it is contemplated that the defined spaces are arranged in any pattern. These imprints of defined spaces comprising the matrix are of any desired single size. A mixture of sizes is contemplated on a single card. It is further contemplated that the defined spaces could be of any shape. Imprints of defined spaces may be added or subtracted as long as each card in the set shares the same number of defined spaces per card. Thus, each row of imprints of defined spaces on a game card in a set of game cards to be used in any one game, be the row horizontal or a vertical or a corner-to-corner diagonal row or any identifiable pattern, is equal in number to any other card in that set of game cards. It is contemplated that the card may have an unequal number of rows in either the horizontal or vertical direction. In this instance the winning card may be a horizontal row, vertical row, or a recognizable shape such as an initial or heart. For example, FIG. 6 sets forth a winning card wherein a horizontal row 1001 is marked off. For example, FIG. 7 sets forth a winning card wherein a vertical row 2001 is marked off. For example, FIG. 8 sets forth a winning card wherein a diagonal row 3001 is marked off. For example, FIG. 9 sets forth a winning card wherein the spaces on the entire card 4001 are marked off. In the preferred implementation, the number of defined spaces should be equal to or less than the number of guests at the party. For example, if the number of guests at the party is ten, the matrix may have nine imprints of defined spaces arranged in rows. If the number of guests is forty, the number of imprints of a defined space may be twenty-five. It is contemplated that the game could be played with the number of defined spaces greater than the number of guests at the party. The size of the card is not considered to be limited, nor is the shape of the card. The game card shape may also be altered to suit the type of gathering at which the game is to be played.

In the preferred implementation, the cards have squares with gift identifiers such as the names of gift items imprinted therein arranged in rows. However, cards with squares with a graphic depiction of the registered gift items imprinted therein are also contemplated. Imprinting both the name and a graphic depiction of the registered gift item are contemplated. The names and graphic depictions of the gift items coincide with the gift items the guest of honor has requested on his or her registered gift list such as a gift registry or wish list. Preferably, the set of gift identifiers is greater than the number of imprints of defined spaces in the matrix to enhance randomization and card uniqueness. Preferably, each gift identifier of the set is randomly assigned to an imprint of a defined space so that no two cards are exactly identical in the placement of names of gift items.

The set of named gift items, also referred to as a registered gift list, is based solely upon the list of specific gift items that the guest of honor has requested on a registered gift list such as a gift registry. However, it is also contemplated that the guest of honor may request gifts using a wish list format. The gift registry corresponds to the type of occasion being celebrated. Such as, for example, at a baby shower, the guest of honor may request items such as "purple flowered crib sheets", "diaper changing pad", "one piece jumpsuits size 3 to 6 months", "cherry wood dresser", and so on. Any occasion at which a guest or guests of honor would receive gifts is contemplated. These names of items would then be randomly arranged on a game card having defined spaces imprinted thereon in a matrix of like sizes and then re-arranged on other game cards to form a set. Alternatively, the defined space itself is a graphic depiction of the gift item and no names imprinted in the spaces are required. It is further contemplated that the game card would have defined spaces wherein both the name of the gift item and a image thereof would be imprinted thereon. Thus, each game card has a plurality of defined spaces arranged in a matrix and the arrangement of the defined spaces varies from game card to game card. Populating the game card using the registered gift list provides a personalized, tailor-made version of the game that further enhances the enjoyment of both the guest of honor and the participants.

Figure 11:
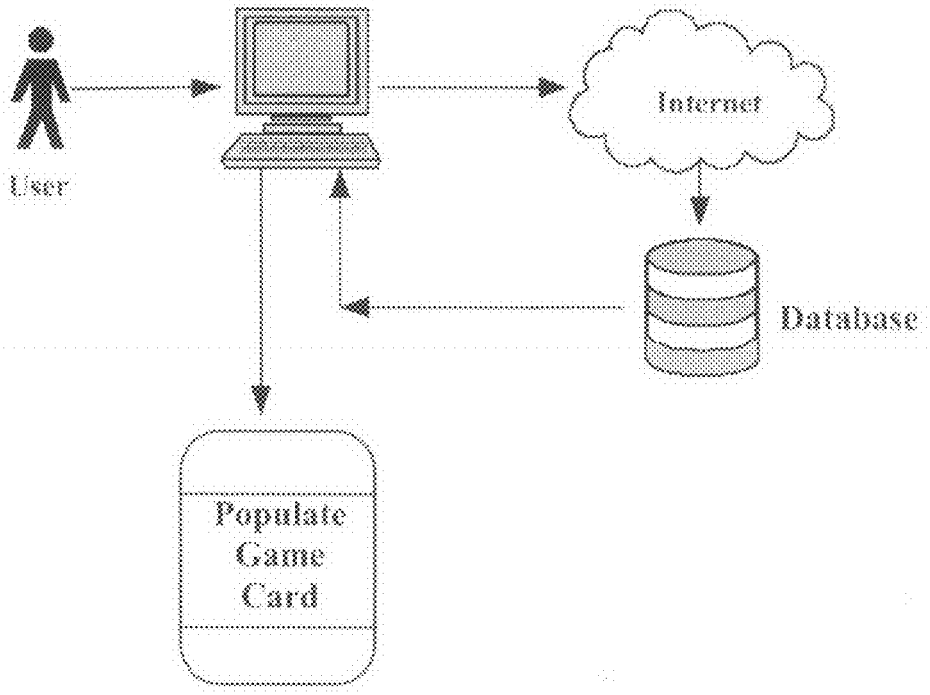
FIG. 11 is a flowchart representation of an implementation of the present invention.

Referring to FIG. 11, in another implementation, the population of at least one gift identifier on a card is automated by linking to one or more registered gift lists via a computer network such as the Internet. The registered gift items are maintained in one or more databases accessible through, for example, a website and the pool of information is downloaded and populated into one or more defined spaces on a card. It is contemplated that the card population can be executed automatically or an individual can populate the squares manually.

The game cards are preferably made of a heavy weight paper. However, any material that can receive and hold a mark may be used. The type of marker that is used is determined by the game card material. For example, when the card is composed of paper, a pen, a pencil, a crayon, or some form of sticker is used to mark the items in the spaces as the item is opened. Alternatively, if the card is slate or slate-like, chalk or stickers are used. Multiple possible combinations of card type and marker can be used.

Figure 10:
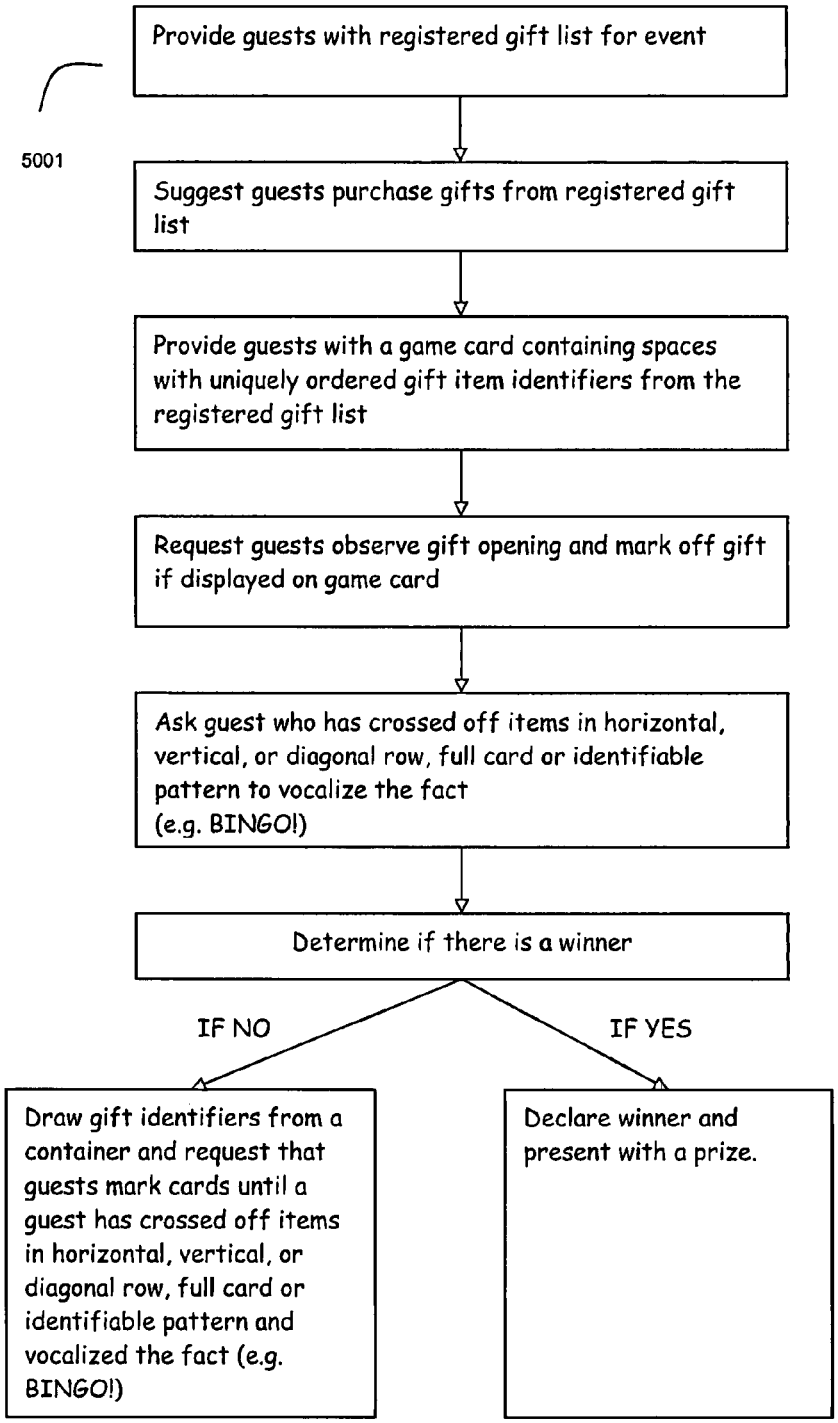
FIG. 10 is a flowchart representation of an implementation of a method of playing a game according to the present invention.

Referring to FIG. 10, a method 5001 for playing a game at a baby shower is shown in a series of steps. The guests are provided with a registered gift list upon which the guest of honor has requested specific gift items pertaining to the occasion being celebrated. The host or guest of honor suggests to each guest to purchase a gift item for the guest of honor listed on such registered gift list. At the event, the guests are provided with a unique game card imprinted with defined spaces with the names and graphic depictions of gift items the guest of honor has requested on her registered gift list and a marker corresponding to the card material. The host or guest of honor requests each guest to observe the mother-to-be opening her gifts and mark off each gift displayed on their game card. The host or guest of honor asks the first guest who has marked all the defined spaces in either a horizontal, vertical, diagonal row, or identifiable pattern to vocalize such act using a word such as "Bingo!". The guest who has vocalized such act is presented with a reward for being the winner of the game, such as for example a bottle of bath oil. In another implementation, if no participant is able to mark off all of the specified defined spaces, the guest of honor or other participant will draw gift identifiers out of a container and request that the guest mark off the corresponding gift items until the guest has marked off all the specified defined spaces.

An alternative method of playing the game is to ask the first guest who has marked off all the gift identifiers on the card to vocalize such act. In this variation, the gift registry is used to produce different game cards, each card having a unique set of gift identifiers imprinted thereon, so that no two cards in the set of cards share all of the same gift identifiers.

In the preferred implementation, each participant is given a card to mark off. However, it is contemplated that more than one participant can share a card and play the game as a team.

Modifications and variations can be made to the disclosed subject matter without departing from the subject and spirit of the invention as defined in the following claims. Such modifications and variations, as included within the scope of these claims, are meant to be considered part of the invention as described.

What is claimed is:

1. A method of playing a game, the method comprising:

creating a registered gift list;

providing a plurality of gift items at least one of said gift items having been purchased from a registered gift list;

providing a barrier for individually concealing each of said gift items from view;

providing said participant with a card imprinted with a plurality of gift identifiers, each gift identifier imprinted in a defined space, each defined space aligned on said card, all of said gift identifiers associated with items listed on the guest of honor's registered gift list;

providing said participant with a marker for making marks on said card;

instructing said guest of honor to remove such barrier thereby providing a revealed gift item;

instructing said participant to mark off said gift identifier on said card, when said gift identifier corresponds to said revealed gift item, said guest of honor continuing to remove said barrier from other gift items providing additional revealed gift items until said participant has marked off gift identifiers in a specified number of spaces; and instructing said participant to vocalize a response when all of said gift identifiers in the specified number of spaces have been marked at which time said participant is declared a winner and further comprising a participant drawing one or more gift identifies from a container until such time as a participant can be declared a winner.

2. The method of claim 1 wherein the specified number of spaces comprises a row.

3. The method of claim 1 wherein the specified number of spaces comprises a column.

4. The method of claim 1 wherein the specified number of spaces comprises a corner to corner diagonal row.

5. The method of claim 1 wherein the specified number of spaces comprises all the spaces imprinted on the card.

6. The method of claim 1 wherein the specified number of spaces is arranged in an identifiable pattern.

7. The method of claim 1 wherein the barrier comprises one of wrapping paper, gift bag, a sheet, a screen, or a covering.

* * * * *